US008248302B2

(12) United States Patent
Tsai et al.

(10) Patent No.: US 8,248,302 B2
(45) Date of Patent: Aug. 21, 2012

(54) REFLECTION-TYPE PHASE SHIFTER HAVING REFLECTION LOADS IMPLEMENTED USING TRANSMISSION LINES AND PHASED-ARRAY RECEIVER/TRANSMITTER UTILIZING THE SAME

(75) Inventors: Ming-Da Tsai, Miaoli County (TW); Arun Natarajan, White Plains, NY (US)

(73) Assignees: Mediatek Inc., Hsin-Chu (TW); International Business Machines Corporation, Armonk, NY (US)

( * ) Notice: Subject to any disclaimer, the term of this patent is extended or adjusted under 35 U.S.C. 154(b) by 233 days.

(21) Appl. No.: 12/411,397

(22) Filed: Mar. 26, 2009

(65) Prior Publication Data

US 2009/0278624 A1 Nov. 12, 2009

Related U.S. Application Data

(60) Provisional application No. 61/052,611, filed on May 12, 2008.

(51) Int. Cl.
*H01Q 3/36* (2006.01)
*H01P 1/18* (2006.01)

(52) U.S. Cl. ..... 342/372; 342/375; 333/164; 333/139; 333/117

(58) Field of Classification Search ..... 333/164, 333/156, 139, 109, 117; 342/372, 375
See application file for complete search history.

(56) References Cited

U.S. PATENT DOCUMENTS

| | | | | |
|---|---|---|---|---|
| 3,882,431 | A * | 5/1975 | Hopwood et al. | 333/139 |
| 4,525,691 | A * | 6/1985 | Kameya | 333/139 |
| 4,859,972 | A * | 8/1989 | Franke et al. | 333/164 |
| 6,741,207 | B1 * | 5/2004 | Allison et al. | 342/371 |
| 6,806,792 | B2 * | 10/2004 | Penn | 333/164 |
| 7,164,330 | B2 | 1/2007 | Eom | |
| 7,538,635 | B2 * | 5/2009 | Fukuda et al. | 333/117 |
| 2005/0270122 | A1 * | 12/2005 | Hyman et al. | 333/164 |

FOREIGN PATENT DOCUMENTS

| | | |
|---|---|---|
| CN | 1577970 A | 2/2005 |
| JP | H0897602 A | 4/1996 |

(Continued)

OTHER PUBLICATIONS

Hitoshi Hayashi, "A High-Q Broad-Band Active Inductor and its Application to a Low-Loss Analog Phase Shifter", IEEE Transactions on Microwave Theory and Techniques, vol. 44, No. 12, Dec. 1996.

(Continued)

*Primary Examiner* — Benny Lee
(74) *Attorney, Agent, or Firm* — Winston Hsu; Scott Margo

(57) ABSTRACT

A reflection-type phase shifter is provided. The reflection-type phase shifter has a coupler, a first reflection load, and a second reflection load. The coupler has an input port for receiving an input signal and an isolated port for outputting an output signal due to a first reflected signal at a through port and a second reflected signal at a coupled port. The first reflection load reflects the first fraction of the input signal to thereby generate the first reflected signal. The second reflection load reflects the second fraction of the input signal to thereby generate the second reflected signal. In addition, at least one of the first and second reflection loads is a transmission line.

11 Claims, 8 Drawing Sheets

FOREIGN PATENT DOCUMENTS

| | | | |
|---|---|---|---|
| JP | H09326625 | A | 12/1997 |
| TW | 554564 | B | 9/2003 |

OTHER PUBLICATIONS

Hossein Zarei, "A Low-Loss Phase Shifter in 180nm CMOS for Multiple-Antenna Receivers", ISSCC 2004/Session 21/RF Potpourri/21.8, 2004.
S. Nam, "RF and microwave phase shifter using complementary bias techniques", Electronics Letters, vol. 37, No. 18, Aug. 30, 2001.
Dongsu Kim, "A Wide-Band Reflection-Type Phase Shifter at S-Band Using BST Coated Substrate", IEEE Transactions on Microwave Theory and Techniques, vol. 50, No. 12, Dec. 2002.
Kenichi Miyaguchi, "An Ultra-Broad-Band Reflection-Type Phase-Shifter MMIC With Series and Parallel LC Circuits", IEEE Transactions on Microwave Theory and Techniques, vol. 49, No. 12, Dec. 2001.
Chao Lu, "Development of Multiband Phase Shifters in 180-nm RF CMOS Technology With Active Loss Compensation", IEEE Transactions on Microwave Theory and Techniques, Vol. 54, No. 1, Jan. 2006.
Amit S. Nagra, "Distributed Analog Phase Shifters with Low Insertion Loss", IEEE Transactions on Microwave Theory and Techniques, vol. 47, No. 9, Sep. 1999.
Frank Ellinger, "Varactor-Loaded Transmission-Line Phase Shifter at C-Band Using Lumped Elements", IEEE Transactions on Microwave Theory and Techniques, vol. 51, No. 4, Apr. 2003.
Hong-Teuk Kim, "Millimetre-wave CPS distributed analogue MMIC phase shifter", Electronics Letters, vol. 39, No. 23, Nov. 13, 2003.
Timothy M. Hancock, "A 12-GHz SiGe Phase Shifter With Integrated LNA", IEEE Transactions on Microwave Theory and Techniques, vol. 53, No. 3, Mar. 2005.
Liang-Hung Lu, "A 4-GHz Phase Shifter MMIC in 0.18-um CMOS", IEEE Microwave and Wireless Components Letters, vol. 15, No. 10, Oct. 2005.
Dong-Woo Kang, "Ku-Band MMIC Phase Shifter Using a Parallel Resonator With 0.18-um CMOS Technology", IEEE Transactions on Microwave Theory and Techniques, vol. 54, No. 1, Jan. 2006.
Hitoshi Hayashi, "A Miniaturized MMIC Analog Phase Shifter Using Two Quarter-Wave-Length Transmission Lines", IEEE Transactions on Microwave Theory and Techniques, vol. 50, No. 1, Jan. 2002.
Dongsu Kim, "2.4 GHz Continuously Variable Ferroelectric Phase Shifters Using All-Pass Networks", IEEE Microwave and Wireless Components Letter, vol. 13, No. 10, Oct. 2003.

* cited by examiner

REFLECTION-TYPE PHASE SHIFTER HAVING REFLECTION LOADS IMPLEMENTED USING TRANSMISSION LINES AND PHASED-ARRAY RECEIVER/TRANSMITTER UTILIZING THE SAME

CROSS REFERENCE TO RELATED APPLICATIONS

This non-provisional application claims the benefit of U.S. provisional application No. 61/052,611, filed on May 12, 2008 and included herein by reference.

BACKGROUND

The present invention relates to a phase shifter and related application thereof, and more particularly, to a reflection-type phase shifter having a coupler with at one of a through port and a coupled port being connected to a transmission line, and a phased-array receiver or transmitter having the reflection-type phase shifter implemented therein.

Phase shifters are common components employed in a variety of wireless communication applications. For example, a phased-array receiver requires phase shifters to achieve desired beamforming. Please refer to FIG. 1. FIG. 1 is a diagram illustrating a conventional reflection-type phase shifter. The conventional reflection-type phase shifter 100 includes a quadrature coupler 102 and a plurality of capacitors 104, 106. As shown in FIG. 1, the quadrature coupler 102 includes an input port Pl, a through port (direct port) P2, a coupled port P3, and an isolated port (output port) P4. The quadrature coupler 102 is also called 90-degree hybrid coupler used for dividing an input signal into two signals with 90 degrees out of phase. In addition, the power of the input signal is also split exactly in half (−3 dB) by the conventional quadrature coupler 102. When the input signal is represented by: $\alpha 1=1\angle 0°$, a first fraction of the input signal at the through port P2 is represented by:

$$b2 = \frac{1}{\sqrt{2}}\angle -90°,$$

and a second fraction of the input signal at the coupled port P3 is represented by:

$$b3 = \frac{1}{\sqrt{2}}\angle -180°.$$

In general, the loads viewed by the signals b2 and b3 are matched to each other, and have the same reflection coefficient Γ being a complex number having a magnitude component and a phase component in a polar representation. As shown in FIG. 1, the capacitors 104 and 106 both act as reflection loads with an equivalent impedance $$\frac{1}{j\omega C}$$

respectively viewed by the signal b2 and b3, where C is the capacitance of the capacitors 104 and 106. The signals respectively reflected (i.e., designated by Γ) from the loads (i.e., the capacitors 104 and 106) are represented by:

$$a2 = \frac{\Gamma}{\sqrt{2}}\angle -90° \text{ and } a3 = \frac{\Gamma}{\sqrt{2}}\angle -180°.$$

The reflected signals a2 and a3 are then combined out of phase at the input port P1 (i.e., $$b1 = \frac{\Gamma}{2}\angle 0° + \frac{\Gamma}{2}\angle -180° = 0),$$

resulting in no reflected signal output from the input port P1. However, the reflected signals a2 and a3 are combined in phase at the isolated port P4 (i.e., $$b4 = \frac{\Gamma}{2}\angle 90° + \frac{\Gamma}{2}\angle 90° \neq 0),$$

resulting in an output signal b4 induced at the isolated port P4. The reflection-type phase shifter 100 therefore can be used to provide a desired phase shift by properly tuning the capacitance of the implemented capacitors 104 and 106 that changes the reflection coefficient Γ which is a complex number. For example, if the capacitance of the capacitors 104, 106 is changed from zero fF (open) to infinite fF (short), 180 degree phase shift can be achieved.

As mentioned above, the reflection loads determine the reflection coefficient Γ which controls the final phase shift of the output signal generated from the reflection-type phase shifter. Therefore, an easy and efficient means to tune the reflection load for changing the reflection coefficient to a desired value is needed.

SUMMARY OF THE INVENTION

It is therefore one of the objectives of the present invention to provide a reflection-type phase shifter having a quadrature coupler with a through port and a coupled port respectively connected to reflection loads of which at least one is a transmission line, thereby providing an easy and efficient means to change the reflection coefficient. In addition, a phased-array receiver or transmitter having reflection-type phase shifters each implemented using the exemplary reflection-type phase shifter architecture of the present invention benefits greatly from the implemented reflection-type phase shifters.

According to one aspect of the present invention, a reflection-type phase shifter is provided. The reflection-type phase shifter includes a coupler, a first reflection load, and a second reflection load. The coupler has an input port for receiving an input signal, a through port for receiving a first fraction of the input signal, a coupled port for receiving a second fraction of the input signal, and an isolated port for outputting an output signal generated due to a first reflected signal at the through port and a second reflected signal at the coupled port. The first reflection load is electrically connected to the through port for reflecting the first fraction of the input signal to thereby generate the first reflected signal to the through port. The second reflection load is electrically connected to the coupled port for reflecting the second fraction of the input signal to thereby generate the second reflected signal to the coupled port. In addition, at least one of the first and second reflection loads is equivalent to a transmission line. In one implementation, the coupler is a quadrature coupler, and the first and second reflection loads are both implemented using tunable transmission lines.

According to another aspect of the present invention, a reflection-type phase shifter is provided. The reflection-type phase shifter includes a quadrature coupler, a first tunable transmission line, and a second tunable transmission line. The quadrature coupler has an input port for receiving an input signal, a through port for receiving a first fraction of the input signal, a coupled port for receiving a second fraction of the input signal, and an isolated port for outputting an output signal generated due to a first reflected signal at the through port and a second reflected signal at the coupled port. The first tunable transmission line is electrically connected to the through port, and is used for reflecting the first fraction of the input signal to thereby generate the first reflected signal to the through port. The second tunable transmission line is electrically connected to the coupled port, and is used for reflecting the second fraction of the input signal to thereby generate the second reflected signal to the coupled port.

According to further another aspect of the present invention, a phased-array receiver is provided. The phased-array receiver includes a plurality of signal receiving modules for receiving wireless signals, a plurality of reflection-type phase shifter, and a signal combiner. The reflection-type phase shifters are electrically connected to the signal receiving modules respectively, and each of the reflection-type phase shifters includes a coupler, a first reflection load, and a second reflection load. The coupler has an input port for receiving an input signal generated from a corresponding signal receiving module, a through port for receiving a first fraction of the input signal, a coupled port for receiving a second fraction of the input signal, and an isolated port for outputting an output signal generated due to a first reflected signal at the through port and a second reflected signal at the coupled port. The first reflection load is electrically connected to the through port, and is used for reflecting the first fraction of the input signal to thereby generate the first reflected signal to the through port. The second reflection load is electrically connected to the coupled port, and is used for reflecting the second fraction of the input signal to thereby generate the second reflected signal to the coupled port, where at least one of the first and second reflection loads is a transmission line. The signal combiner is electrically connected to the reflection-type phase shifters, and is used for combining output signals respectively generated from the reflection-type phase shifters to generate a combined signal.

According to yet another aspect of the present invention, a phased-array transmitter is provided. The phased-array transmitter includes a signal splitter, a plurality of reflection-type phase shifters, and a plurality of signal transmitting modules. The signal splitter is configured for receiving an input signal and generating a plurality of splitter output signals according to the input signal. The reflection-type phase shifters are electrically connected to the signal splitter, and receive the splitter output signals respectively. Each of the reflection-type phase shifters includes a coupler, a first reflection load, and a second reflection load. The coupler has an input port for receiving an incoming signal generated from the signal splitter, a through port for receiving a first fraction of the incoming signal received by the input port, a coupled port for receiving a second fraction of the incoming signal received by the input port, and an isolated port for outputting an output signal generated due to a first reflected signal at the through port and a second reflected signal at the coupled port. The first reflection load is electrically connected to the through port, and is configured for reflecting the first fraction of the incoming signal to thereby generate the first reflected signal to the through port. The second reflection load is electrically connected to the coupled port, and is configured for reflecting the second fraction of the incoming signal to thereby generate the second reflected signal to the coupled port. At least one of the first and second reflection loads is a transmission line. The signal transmitting modules are configured for transmitting wireless signals according to output signals generated from the reflection-type phase shifters.

The present invention provides an easy and efficient way to control the reflection-type phase shifter to generate an output signal with a desired phase shift. Therefore, it is easy for the reflection-type phase shifter of the present invention to achieve any desired phase shift for a wireless communication application, such as a beamforming phased-array application.

These and other objectives of the present invention will no doubt become obvious to those of ordinary skill in the art after reading the following detailed description of the preferred embodiment that is illustrated in the various figures and drawings.

DETAILED DESCRIPTION OF THE INVENTION

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". Also, the term "couple" is intended to mean either an indirect or direct electrical connection. Accordingly, if one device is coupled to another device, that connection may be through a direct electrical connection, or through an indirect electrical connection via other devices and connections.

Figure 2:
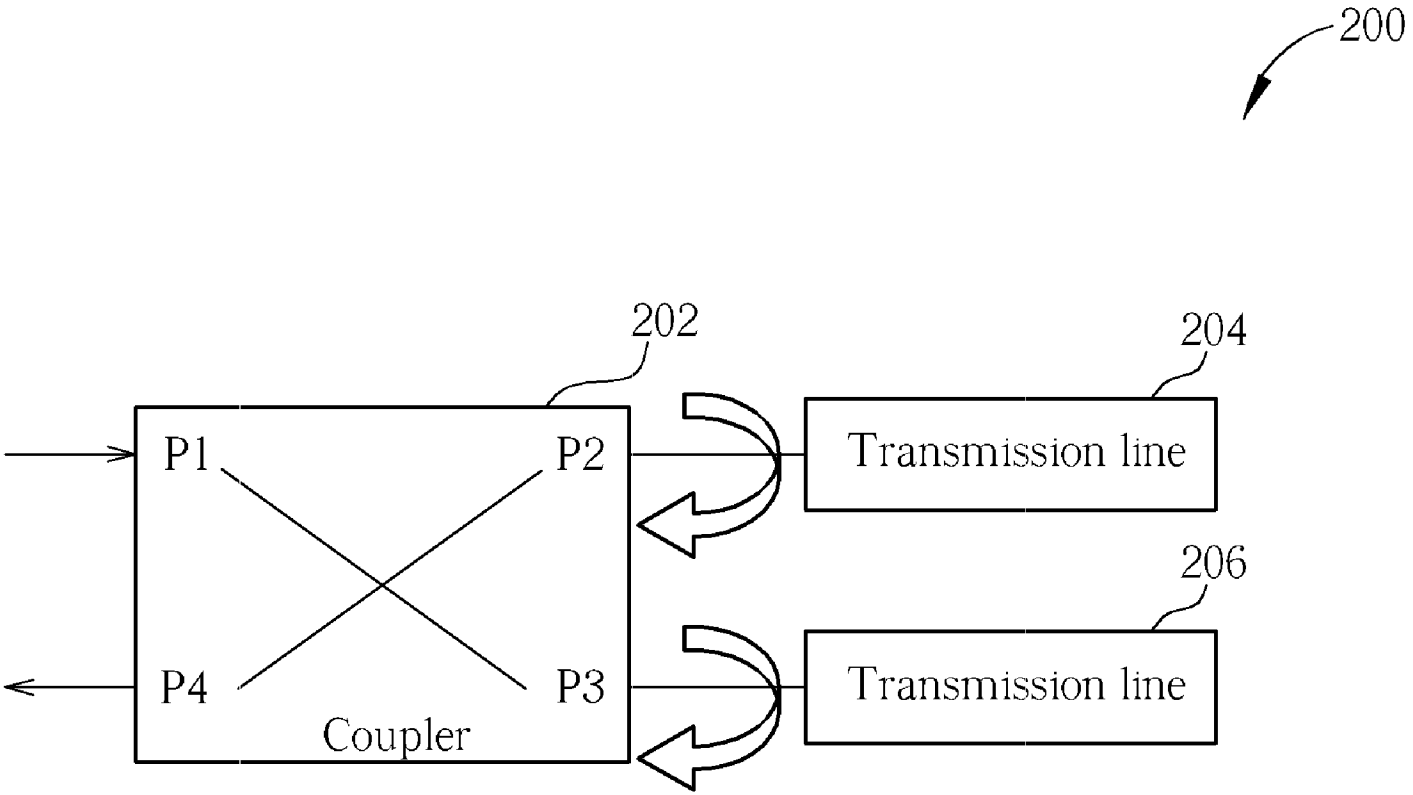
FIG. 2 is a diagram illustrating an exemplary embodiment of a reflection-type phase shifter according to the present invention.

FIG. 2 is a diagram illustrating an exemplary embodiment of a reflection-type phase shifter according to the present invention. The reflection-type phase shifter 200 includes, but is not limited to, a coupler 202 and a plurality of transmission lines 204 and 206 serving as reflection loads. The coupler 202 includes an input port denoted by P1, a through port denoted by P2, a coupled port denoted by P3, and an output port denoted by P4, where the through port P2 and the coupled port P3 are terminated by transmission lines (i.e., reflection loads) 204 and 206, respectively. It should be noted that each of the transmission lines 204 and 206 shown in FIG. 2 can be representative of a single transmission line or a lumped equivalent of multiple transmission lines. In this exemplary embodiment, the coupler 202 is implemented using a quadrature coupler (i.e., a 90-degree hybrid coupler); however, this is for illustrative purposes only, and is not meant to be a limitation of the present invention. In other words, any reflection-type phase shifter using at least one transmission line to act as a reflection load connected to the coupler still obeys the spirit of the present invention and falls within the scope of the present invention.

Figure 1:
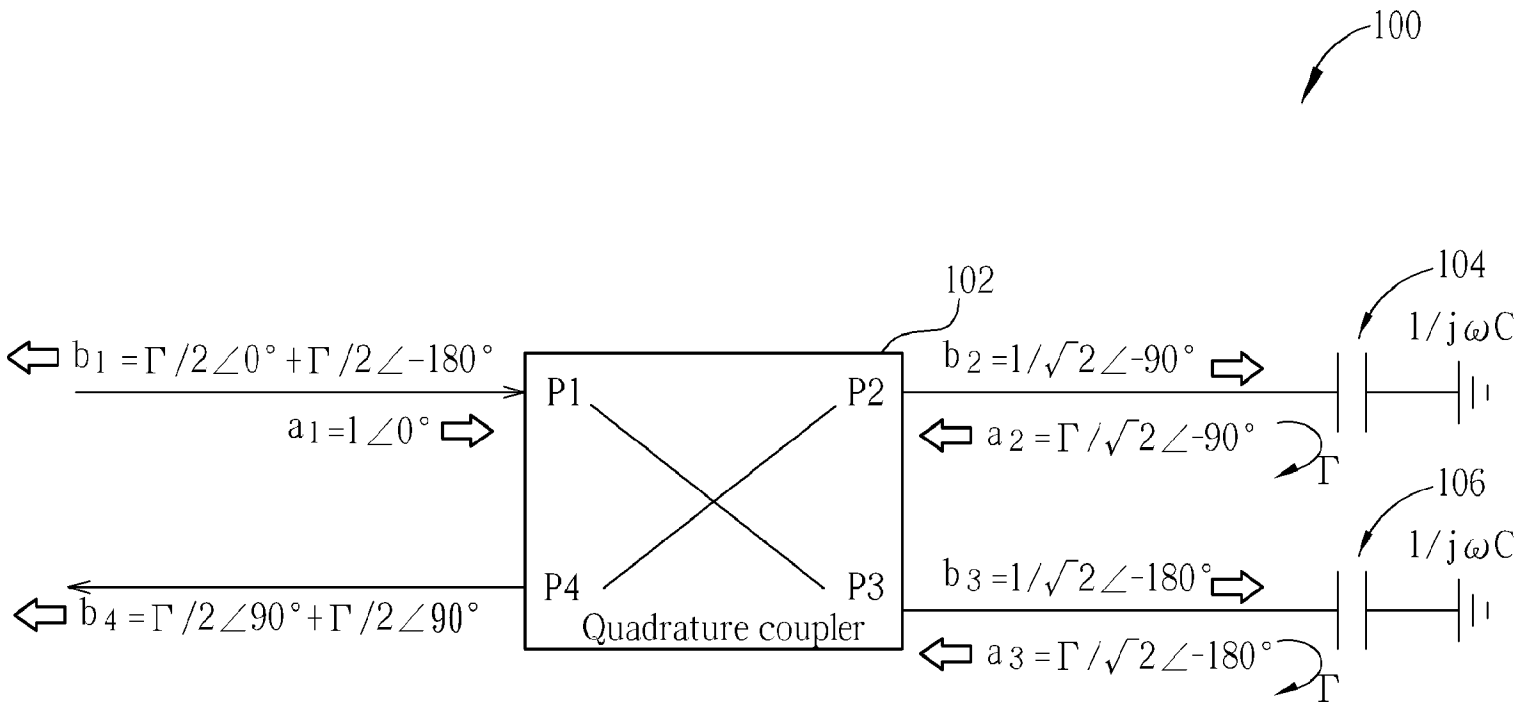
FIG. 1 CONVENTIONAL ART
FIG. 1 is a diagram illustrating a conventional reflection-type phase shifter.

Specifically, in this exemplary embodiment, the reflection loads of the coupler 202 are implemented using tunable transmission lines; that is to say, the impedance of the reflection loads or the electrical equivalent length of the transmission lines is adjustable. In a case where the coupler 202 is implemented using a quadrature coupler, the operation of the reflection-type phase shifter 200 shown in FIG. 2 is similar to that of the conventional reflection-type phase shifter 100 shown in FIG. 1. One of the differences between the exemplary reflection-type phase shifter 200 and the conventional reflection-type phase shifter 100 is that the reflection loads of the quadrature coupler are implemented using two tunable transmission lines instead of two capacitors.

Please note that the transmission line has well-defined characteristics, and should not be treated as a conductive wire. In many electronic circuits, the length of the conductive wire can be ignored as the voltage of a transmitted signal on the conductive wire at a given time can be assumed to be the same at all points of the conductive wire. However, regarding high-frequency applications (e.g., wireless communication applications), the voltage of the transmitted signal changes in a time interval comparable to the time it takes for the signal to travel down the conductive wire. Therefore, the wire length becomes important to the high-frequency applications, and the conductive wire must be treated as a transmission line, that is, taking the transmission line theory into consideration. More specifically, the length of the conductive wire is important when the signal includes frequency components with corresponding wavelengths comparable to or less than the length of the conductive wire. For example, based on the transmission line characteristics, the transmission line could be modeled or implemented by an LC ladder network having repetitions of an inductor and a capacitor. In other words, as the transmission line has well-defined characteristics, it should not be treated as a random combination of capacitive component(s) and/or inductive component(s). More specifically, the transmission line is defined to include distributed linear electrical components, for example, including distributed series inductors and shunt capacitors. Moreover, the elementary LC units constituting the transmission line have substantially the same impedance. As the definition and characteristic of the transmission line are well known to those skilled in the electromagnetic field, further explanation is omitted here for the sake of brevity.

Figure 3:
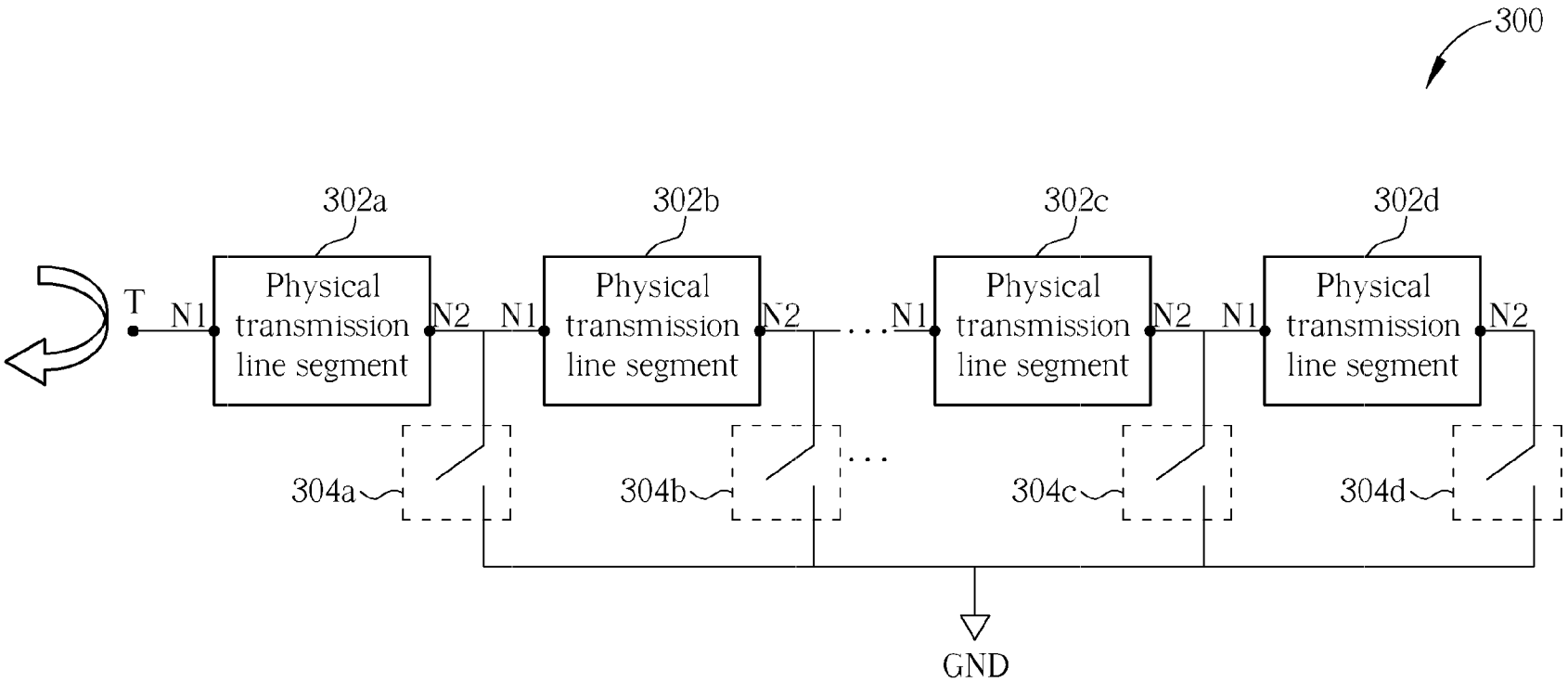
FIG. 3 is a diagram illustrating a first exemplary embodiment of a tunable transmission line according to the present invention.

Please refer to FIG. 3. FIG. 3 is a diagram illustrating a first exemplary embodiment of a tunable transmission line according to the present invention. In one implementation, each of the transmission lines (i.e., the reflection loads utilized in the embodiment) 204 and 206 connected to the coupler 202 shown in FIG. 2 is implemented using the tunable transmission line 300 in FIG. 3. The exemplary tunable transmission line 300 includes a plurality of physical transmission line segments 302*a*, 302*b*, 302*c*, and 302*d* connected in series, and a plurality of controllable switches 304*a*, 304*b*, 304*c*, and 304*d* electrically connected to the physical transmission line segments 302*a*-302*d*, respectively. More specifically, each of the physical transmission line segments 302*a*-302*d* has a first end N1 and a second end N2, and each of the controllable switches 304*a*-304*d* is configured for selectively connecting the second end N2 of a corresponding physical transmission line segment to the ground GND. As shown in FIG. 3, the first end N1 of the physical transmission line segments 302*a* is connected to a terminal T of the tunable transmission line 300, where the terminal T is used to connect the through port P3 or the coupled port P4 of the coupler 202 shown in FIG. 2. In addition, when the reflection-type phase shifter is employed in a high-frequency application, such as an mmWave wireless communication application, switches can be used for tuning the transmission line to achieve the objective of changing the reflection phase. In one example, the controllable switches 304*a*-304*d* can be manufactured using the micro electro-mechanical (MEM) process. In another example, metal-oxide semiconductor (MOS) transistors could be used to implement the controllable switches 304*a*-304*d* shown in FIG. 3.

Please note that only four physical transmission line segments and four controllable switches are shown in FIG. 3 for simplicity. Actually, the total number of physical transmission line segments implemented in the tunable transmission line 300 and the total number of controllable switches implemented in the tunable transmission line 300 depend upon design requirements.

The overall input impedance/effective electrical length of the tunable transmission line 300 can be adjusted by controlling on/off states of the controllable switches 304*a*-304*d*. For example, when the controllable switch 304*a* is switched on for connecting the second node N2 of the physical transmission line segment 302*a* to the ground GND and the remaining controllable switches are switched off, the tunable transmission line 300 is equivalent to the single physical transmission line segment 302*a*; similarly, when the controllable switch 304*b* is switched on for connecting the second node N2 of the physical transmission line segment 302*b* to the ground GND and the remaining controllable switches are switched off, the tunable transmission line 300 is equivalent to a series combination of the physical transmission line segments 302*a* and 304*a*. With proper control of the controllable switches 304*a*-304*d*, the overall input impedance/effective electrical length of the tunable transmission line 300 can be set to a desired value for changing the reflection coefficient, especially shifting the reflection phase. In this way, the output signal generated at the output port P4 therefore has a phase shift satisfying the application requirements.

Figure 4:
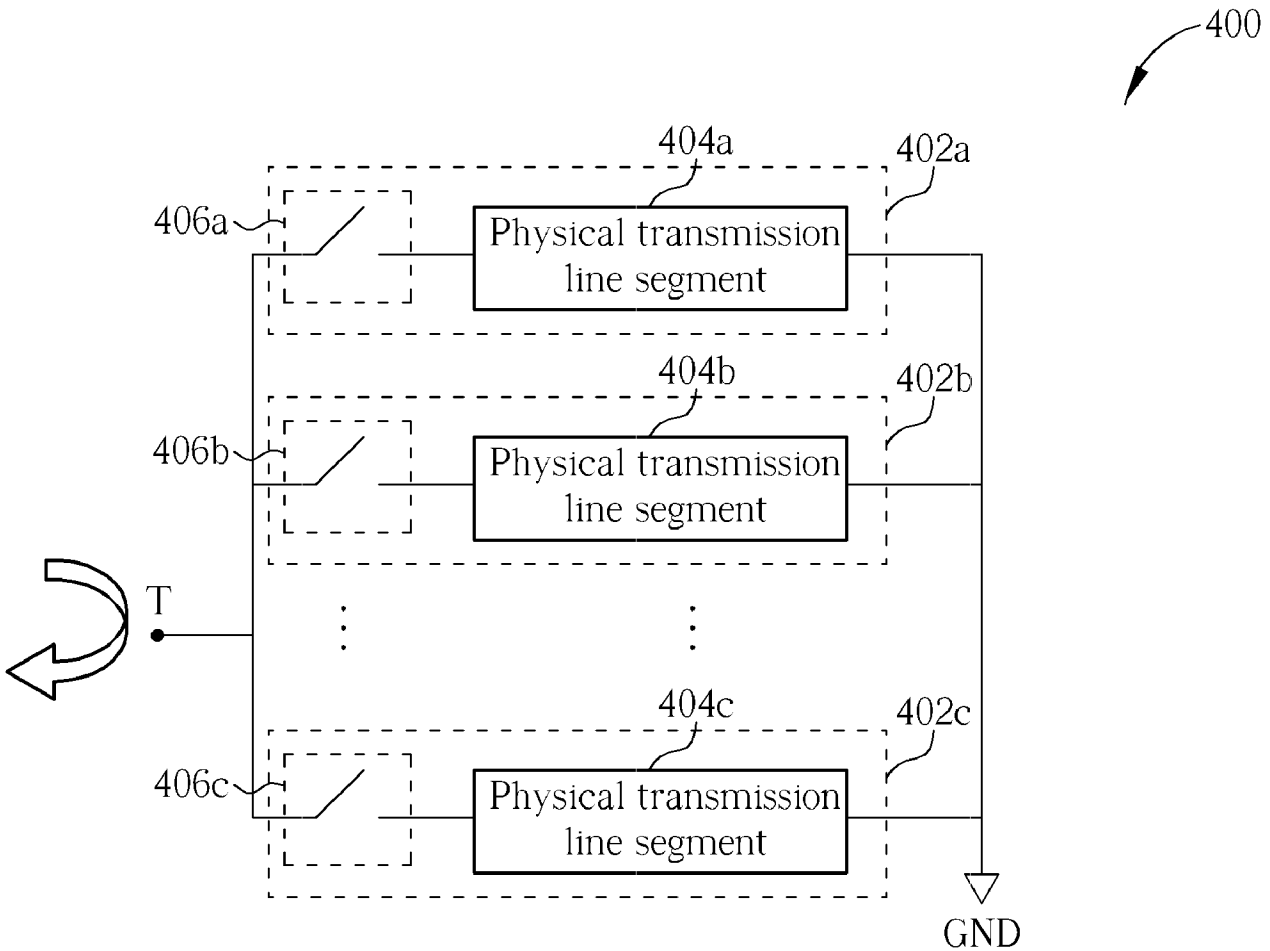
FIG. 4 is a diagram illustrating a second exemplary embodiment of a tunable transmission line according to the present invention.

Please refer to FIG. 4. FIG. 4 is a diagram illustrating a second exemplary embodiment of a tunable transmission line according to the present invention. In one implementation, each of the transmission lines (i.e., the reflection loads utilized in the embodiment) 204 and 206 shown in FIG. 2 is implemented using the tunable transmission line 400 in FIG. 4. The exemplary tunable transmission line 400 includes a plurality of transmission line components 402*a*, 402*b*, and 402*c* connected in parallel, wherein each of transmission line components 402*a*-402*c* is electrically connected between a terminal T of the tunable transmission line 400 and the ground GND, and the terminal T is used to connect the through port P3 or the coupled port P4 of the coupler 202 shown in FIG. 2. In addition, each of the transmission line components 402*a*-402*c* includes a physical transmission line segment, and a controllable switch configured for selectively connecting the physical transmission line segment to the terminal T of the tunable transmission line 400. For example, the transmission line component 402*a* includes a physical transmission line segment 404*a* and a controllable switch 406*a*. Please note that only three transmission line components are shown in FIG. 4 for simplicity. However, the number of transmission line components implemented in the tunable transmission line 400 depends upon design requirements. In addition, the controllable switches could be manufactured using the semiconductor process or MEM process, depending upon requirements of the application employing the reflection-type phase shifter.

In the exemplary embodiment shown in FIG. 4, the lengths of the physical transmission line segments 404*a*, 404*b*, and 404*c* are different, meaning that the characteristics of the physical transmission line segments 404*a*-404*c* are different. In this way, the overall input impedance or effective electrical length of the tunable transmission line 400 can be adjusted by controlling on/off states of the controllable switches 406*a*, 406*b*, and 406*c*. For example, when the controllable switch 406*a* is switched on for connecting the physical transmission line segment 404*a* to the terminal T of the tunable transmission line 400, and the remaining controllable switches are switched off, the tunable transmission line 400 is equivalent to the single physical transmission line segment 404*a*; similarly, when the controllable switch 406*b* is switched on for connecting the physical transmission line segment 404*b* to the terminal T of the tunable transmission line 400, and the remaining controllable switches are switched off, the tunable transmission line 400 is equivalent to the single physical transmission line segment 404*b*. With proper control of the controllable switches 406*a*-406*c*, the overall input impedance/effective electrical length of the tunable transmission line 400 can be set to a desired value for changing the reflection coefficient, especially shifting the reflection phase. In this way, the output signal generated at the output port P4 therefore has a phase shift satisfying the application requirements.

It should be noted that the aforementioned exemplary embodiment is for illustrative purposes only. Actually, it is not limited that the physical transmission lines segments must have different lengths, and only one of the controllable switches is allowed to be turned on. That is, in an alternative design, the physical transmission lines segments are allowed to have the same length, and/or more than one controllable switch can be turned on at the same time. For instance, all of the physical transmission lines segments shown in FIG. 4 are configured to have the same length, and a plurality of controllable switches selected from the controllable switches shown in FIG. 4 are turned on simultaneously to set the overall input impedance/effective electrical length of the tunable transmission line 400 set to a desired value for changing the reflection coefficient, especially shifting the reflection phase. The same objective of making an output signal have a phase shift satisfying the application requirements is therefore achieved.

The implementation of the tunable transmission lines shown in FIG. 3 and FIG. 4 is based on physical transmission line segments, which provides an easy and efficient way to control the reflection-type phase shifter to generate an output signal with a desired phase shift. However, using physical transmission line segments to realize the tunable transmission line is for illustrative purposes only. For instance, as known to those skilled in the art, a transmission line could be approximated by an LC ladder network having repetitions of an inductor and a capacitor.

Figure 5:
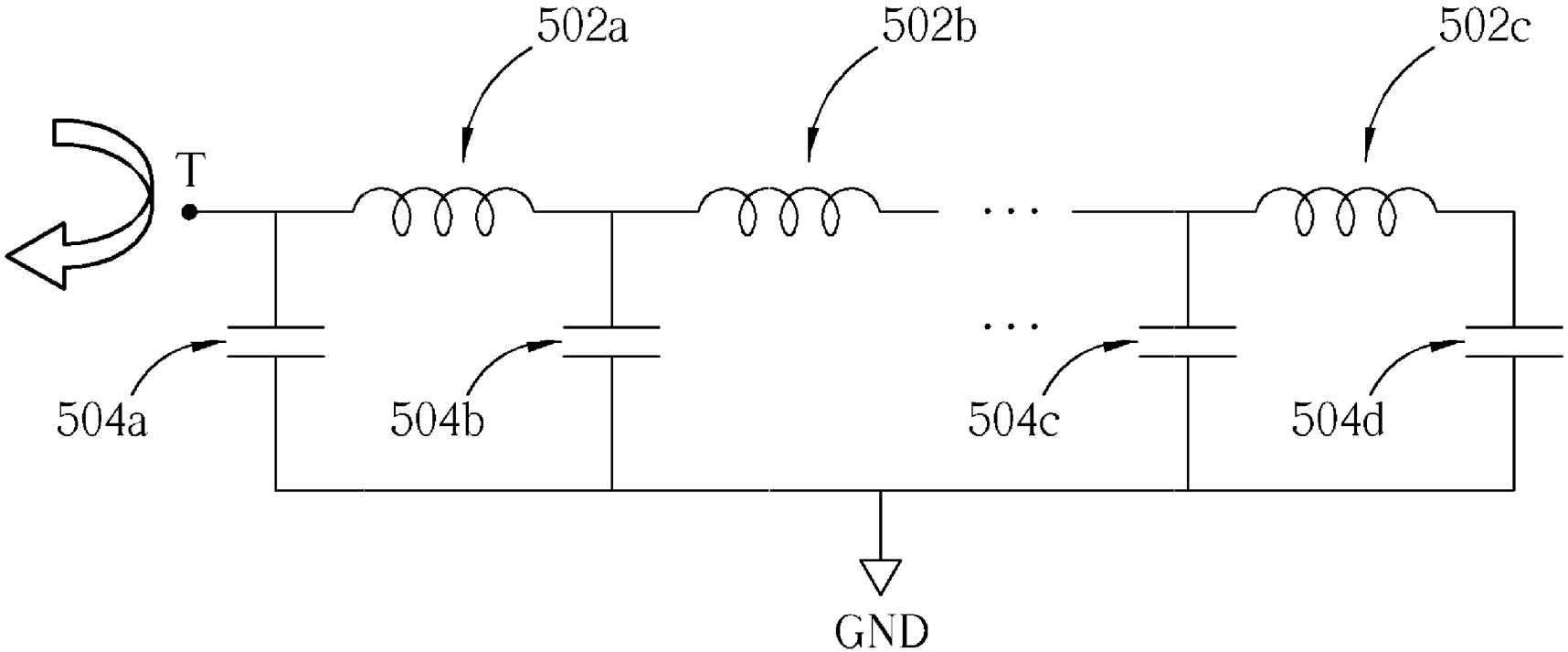
FIG. 5 is a diagram illustrating a third exemplary embodiment of a tunable transmission line according to the present invention.

Please refer to FIG. 5. FIG. 5 is a diagram illustrating a third exemplary embodiment of a tunable transmission line according to the present invention. In one implementation, each of the transmission lines (i.e., the reflection loads in the embodiment) 204 and 206 shown in FIG. 2 is implemented using the tunable transmission line 500 in FIG. 5. The exemplary tunable transmission line 500 is implemented using an LC ladder network comprising a plurality of inductive components 502*a*, 502*b*, and 502*c* and a plurality of capacitive components 504*a*, 504*b*, 504*c*, and 504*d* distributed therein. The capacitive component 504*a* is connected between a terminal T of the tunable transmission line and the ground GND. Please note that only three inductive components and four capacitive components are shown in FIG. 5 for simplicity. However, the total number of inductive components and the total number of capacitive components depend upon design requirement of the application.

In one implementation, the capacitive components 504*a*-504*d* are implemented using tunable capacitive components, such as varactors. However, any technique capable of changing the capacitance could be employed. For example, the tunable capacitive component could be implemented using an array of switches and capacitors, where the resultant capacitance of the tunable capacitive component is determined by controlling the switches to configure the interconnection of the capacitors. The same objective of tuning the capacitance is achieved. Therefore, with proper control of the tunable capacitive components, the overall input impedance/effective electrical length of the tunable transmission line 500 can be set to a desired value for changing the reflection coefficient, especially shifting the reflection phase. In this way, the output signal generated at the output port P4 shown in FIG. 2 therefore has a phase shift satisfying the application requirements.

Figure 8:
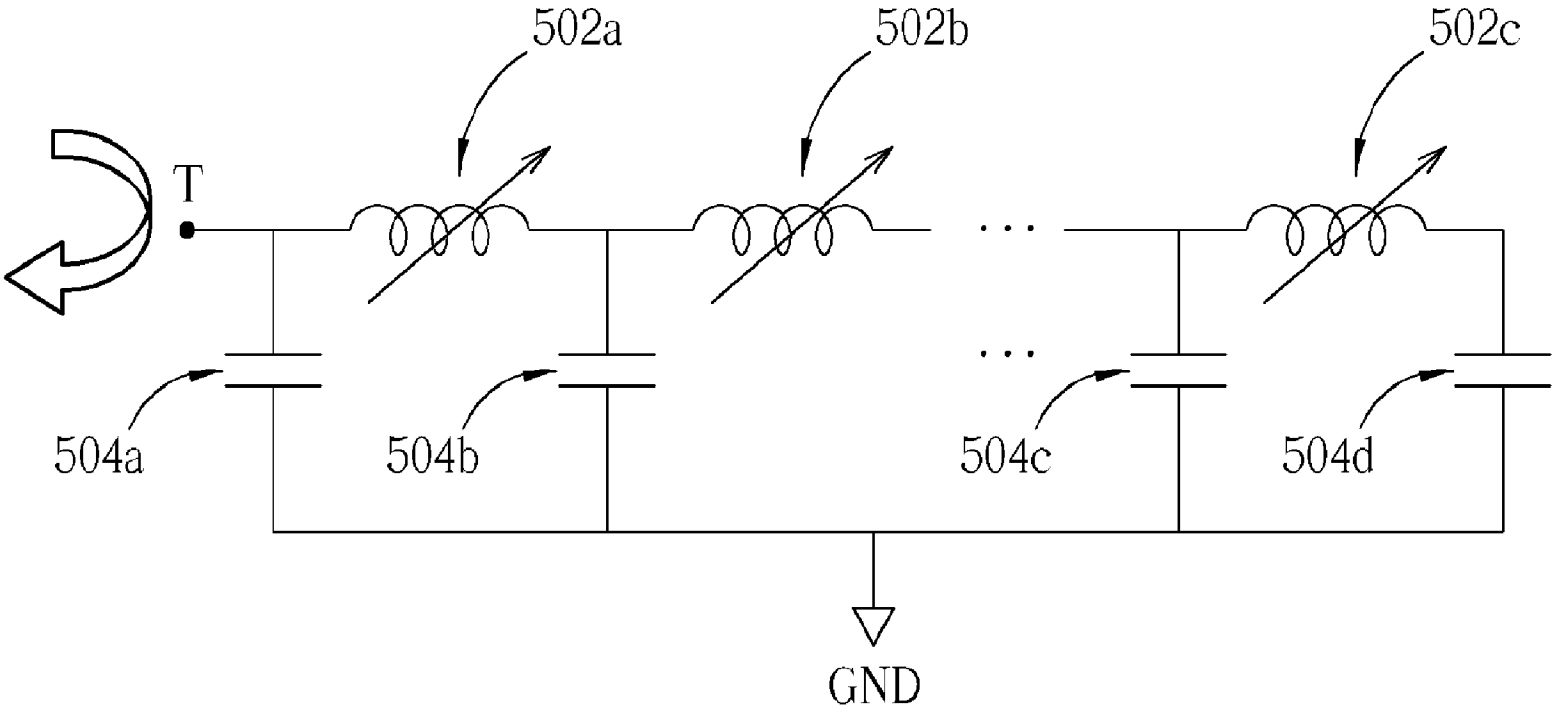
FIG. 8 is a diagram illustrating one exemplary implementation of the tunable transmission line shown in FIG. 5.

In another implementation, the inductive components 502*a*-502*c* are implemented using tunable inductive components, as shown in FIG. 8. Regarding the alternative implementation shown in FIG. 8, it has inductive components 502*a*, 502*b*, and 502*c* and capacitive components 504*a*, 504*b*, 504*c*, and 504*d* distributed therein, where the inductive components 502*a*-502*c* shown in FIG. 8 are tunable inductive components, and each of the capacitive component 504*a*-504*d* shown in FIG. 8 has one end directly connected to the ground GND. It should be noted that any technique capable of changing the inductance could be employed. For example, the tunable inductive component could be implemented using an array of switches and inductors, where the resultant inductance of the tunable inductive component is determined by controlling the switches to configure the interconnection of the inductors. The same objective of tuning the inductance is achieved. Therefore, with proper control of the tunable inductive components, the overall input impedance/effective electrical length of the tunable transmission line 500 can be set to a desired value for changing the reflection coefficient, especially shifting the reflection phase. In this way, the output signal generated at the output port P4 shown in FIG. 2 therefore has a phase shift satisfying the application requirement.

In yet another implementation without departing from the spirit of the present invention, the inductive components 502*a*-502*c* are implemented using tunable inductive components, and the capacitive components 504*a*-504*d* are implemented using tunable capacitive components. The same objective of tuning the reflection coefficient, especially shifting the reflection phase, is achieved.

Briefly summarized, regarding the implementation of using an LC ladder network to model an equivalent transmission line, one or more capacitive components and/or one or more inductive components could be made tunable. In this way, a tunable equivalent transmission line is realized to meet the requirements of reflection phase adjustment.

In aforementioned exemplary embodiments, the reflection loads are both implemented using transmission lines of the same type. For example, each of the transmission lines 204 and 206 shown in FIG. 2 is implemented using the tunable transmission line 300 in FIG. 3. However, this is not meant to be a limitation of the present invention. For instance, in one alternative design of the present invention, the transmission line 204 shown in FIG. 2 is implemented using the tunable transmission line 300 shown in FIG. 3, while the reflection load 206 shown in FIG. 2 is implemented using the tunable transmission line 400 shown in FIG. 4 or the tunable transmission line 500 in FIG. 5; in another alternative design, the transmission line 204 shown in FIG. 2 is implemented using the tunable transmission line 400 shown in FIG. 4, while the transmission line 206 shown in FIG. 2 is implemented using the tunable transmission line 300 shown in FIG. 3 or the tunable transmission line 500 shown in FIG. 5; in yet another alternative design, the transmission line 204 shown in FIG. 2 is implemented using the tunable transmission line 500 shown in FIG. 5, while the transmission line 206 shown in FIG. 2 is implemented using the tunable transmission line 300 shown in FIG. 3 or the tunable transmission line 400 shown in FIG. 4. The above-mentioned alternative designs still obey the spirit of the present invention, and fall within the scope of the present invention.

In conclusion, the present invention provides an easy way to control the reflection-type phase shifter to generate an output signal with a desired phase shift. Therefore, it is easy for the reflection-type phase shifter of the present invention to achieve a desired phase shift required by an application, such as the beamforming phased-array application.

Figure 6:
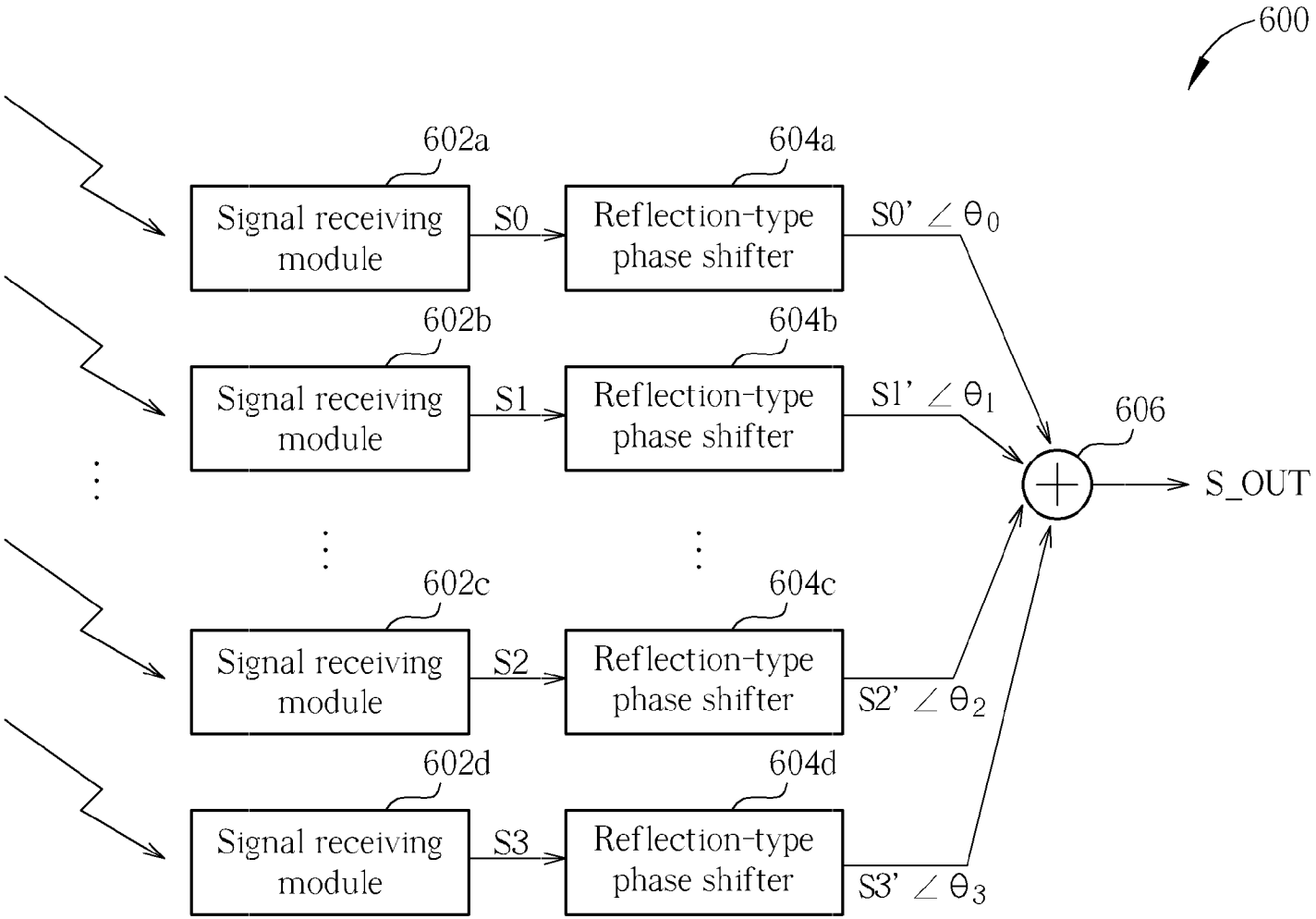
FIG. 6 is a diagram illustrating an exemplary embodiment of a phased-array receiver according to the present invention.

Please refer to FIG. 6 in conjunction with FIG. 2. FIG. 6 is a diagram illustrating an exemplary embodiment of a phased-array receiver including reflection-type phase shifters each having the phase shifter architecture shown in FIG. 2. The phased-array receiver 600 includes, but is not limited to, a plurality of signal receiving modules 602*a*, 602*b*, 602*c*, and 602*d*, a plurality of reflection-type phase shifters 604*a*, 604*b*, 604*c*, and 604*d*, and a signal combiner 606. Please note that only four signal receiving modules and four reflection-type phase shifters are shown in FIG. 6 for simplicity. The signal receiving modules 602*a*-602*d* are used to receive wireless signals which may have different phases, and then generate a plurality of received signals S0, S1, S2, S3. In this exemplary embodiment, each of the reflection-type phase shifters 604*a*-604*d* shown in FIG. 6 is implemented using the phase shifter architecture shown in FIG. 2. In addition, with proper control of the tunable transmission lines (i.e., the reflection loads) coupled to the quadrature coupler, the reflection-type phase shifters 604*a*-604*d* can be easily configured to have different desired reflection phases satisfying design requirements of the phased-array receiver 600. As the operation and characteristic of the exemplary reflection-type phase shifter of the present invention have been detailed in above paragraphs, further description is omitted here for brevity.

The reflection-type phase shifter 604*a*-604*d* receive the received signals S0, S1, S2, S3 which serve as input signals at corresponding input ports thereof, and then generate a plurality of phase-shifted signals S0'$\angle\theta_0$, S1'$\angle\theta_1$, S2'$\angle\theta_2$, S3'$\angle\theta_3$ which serve as output signals at the corresponding output ports thereof. Next, the signal combiner 606 combines the phase-shifted signals S0'$\angle\theta_0$, S1'$\angle\theta_1$, S2'$\angle\theta_2$, S3'$\angle\theta_3$ (i.e., output signals of the reflection-type phase shifters 604*a*-604*d*) to thereby generate a combined signal S_OUT for following signal processing. For example, in one exemplary implementation, each of the signal receiving modules 602*a*-602*d* includes an antenna used for receiving the incoming wireless signal and a low-noise amplifier (LNA) used for amplifying an incoming signal to be fed into a following stage (e.g., a reflection-type phase shifter), and the combined signal S_OUT generated from the signal combiner 606 is down-converted using a mixer. Regarding another possible implementation, the mixer required for performing the down-conversion could be included in each of the signal receiving modules 602*a*-602*d*, and the combined signal S_OUT generated from the signal combiner 606 is therefore ready for base-band signal processing. Briefly summarized, the reflection-type phase shifter according to an exemplary embodiment of the present invention can be applied to any phased-array receiver architecture which requires phase shifters to be implemented therein.

Figure 7:
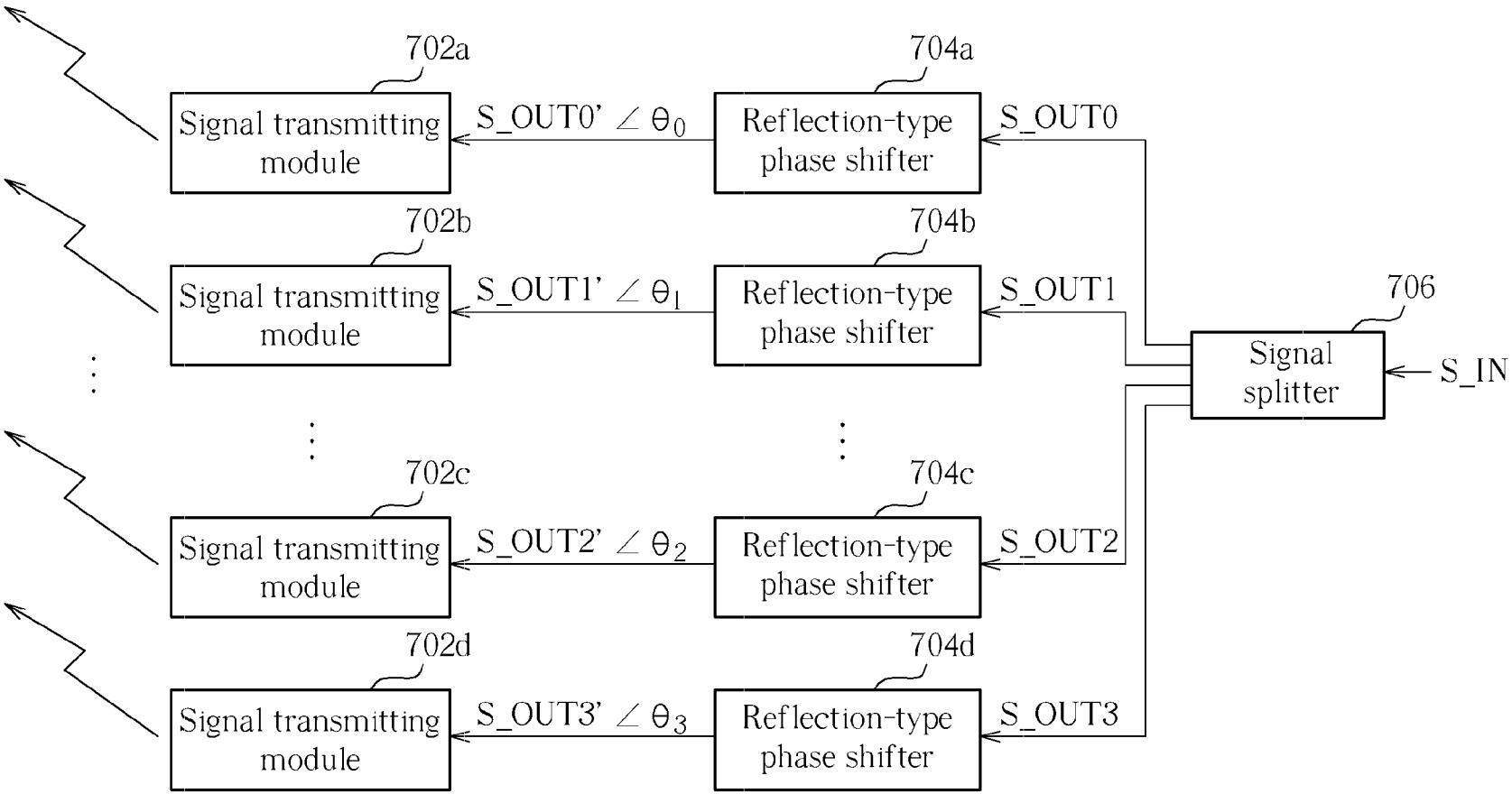
FIG. 7 is a diagram illustrating an exemplary embodiment of a phased-array transmitter according to the present invention.

Please refer to FIG. 7 in conjunction with FIG. 2. FIG. 7 is a diagram illustrating an exemplary embodiment of a phased-array transmitter including reflection-type phase shifters each having the phase shifter architecture shown in FIG. 2. The phased-array transmitter 700 includes, but is not limited to, a plurality of signal transmitting modules 702*a*, 70*b*, 702*c*, and 702*d*, a plurality of reflection-type phase shifters 704*a*, 704*b*, 704*c*, and 704*d*, and a signal splitter 706. Please note that only four signal transmitting modules and four reflection-type phase shifters are shown in FIG. 7 for simplicity. In this exemplary embodiment, each of the reflection-type phase shifters 704*a*-704*d* shown in FIG. 7 is implemented using the phase shifter architecture shown in FIG. 2. In addition, with proper control of the tunable transmission lines (i.e., the reflection loads) coupled to the quadrature coupler, the reflection-type phase shifters 704*a*-704*d* can be easily configured to have different desired reflection phases satisfying design requirements of the phased-array transmitter 700. As the operation and characteristic of the exemplary reflection-type phase shifter of the present invention have been detailed in above paragraphs, further description is omitted here for brevity.

The signal splitter 706 generates a plurality of splitter output signals S_OUT0, S_OUT1, S_OUT2, S_OUT3 according to an input signal S_IN, and then outputs the splitter output signals S_OUT0, S_OUT1, S_OUT2, S_OUT3 to the reflection-type phase shifters 704*a*-704*d*, respectively. As the splitter output signals S_OUT0, S_OUT1, S_OUT2, S_OUT3 derived from the input signal S_IN respectively serve as input signals received at input ports of the reflection-type phase shifters 704*a*-704*d*, the reflection-type phase shifters 704*a*-704*d* therefore generate a plurality of phase-shifted signals S_OUT0'$\angle\theta_0$, S_OUT1'$\angle\theta_1$, S_OUT2'$\angle\theta_2$, S_OUT3'$\angle\theta_3$ which serve as output signals at the corresponding output ports thereof. Next, the signal transmitting modules 702*a*-702*d* process the phase-shifted signals S_OUT0'$\angle\theta_0$, S_OUT1'$\angle\theta_1$, S_OUT2'$\angle\theta_2$, S_OUT3'$\angle\theta_3$ (i.e., output signals of the reflection-type phase shifters 704*a*-704*d*) to thereby transmit a plurality of outgoing wireless signals, respectively.

For example, in one exemplary implementation, the input signal S_IN is an up-converted signal generated from a mixer, and each of the signal transmitting modules 702*a*-702*d* includes a power amplifier used for amplifying a phase-shifted signal generated from a corresponding reflection-type phase shifter and an antenna used for transmitting an outgoing wireless signal according to an output of the corresponding power amplifier. Regarding another possible implementation, the input signal S_IN is a base-band signal, and the mixer required for performing the up-conversion could be included in each of the signal transmitting modules 702*a*-

702*d*. Briefly summarized, the reflection-type phase shifter according to an exemplary embodiment of the present invention can be applied to any phased-array transmitter architecture which requires phase shifters to be implemented therein.

Please note that in certain applications which have the phased-array receiver 600 in FIG. 6 and the phased-array transmitter 700 in FIG. 7 implemented therein, some circuit components can be shared between the phased-array receiver and the phased-array transmitter to reduce the circuitry area as well as the production cost.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A reflection-type phase shifter, comprising:

a coupler, having an input port for receiving an input signal, a through port for receiving a first fraction of the input signal, a coupled port for receiving a second fraction of the input signal, and an isolated port for outputting an output signal generated due to a first reflected signal at the through port and a second reflected signal at the coupled port;

a first reflection load, electrically connected to the through port, for reflecting the first fraction of the input signal to thereby generate the first reflected signal to the through port; and a second reflection load, electrically connected to the coupled port, for reflecting the second fraction of the input signal to thereby generate the second reflected signal to the coupled port;

wherein at least one of the first and second reflection loads is a tunable transmission line comprising:

a plurality of physical transmission line segments connected in series, wherein each of the plurality of physical transmission line segments has a first end and a second end; and a plurality of controllable switches, electrically connected to the plurality of physical transmission line segments respectively, wherein each of the plurality of controllable switches has one end directly connected to ground, and each of the plurality of controllable switches is configured for selectively connecting the second end of a corresponding physical transmission line segment to the ground.

2. The reflection-type phase shifter of claim 1, wherein the coupler is a quadrature coupler.

3. A phased-array receiver, comprising:

a plurality of signal receiving modules, configured for receiving wireless signals;

a plurality of reflection-type phase shifters, electrically connected to the plurality of signal receiving modules respectively, each of the plurality of reflection-type phase shifters comprising:

a coupler, having an input port for receiving an input signal generated from a corresponding signal receiving module, a through port for receiving a first fraction of the input signal, a coupled port for receiving a second fraction of the input signal, and an isolated port for outputting an output signal generated due to a first reflected signal at the through port and a second reflected signal at the coupled port;

a first reflection load, electrically connected to the through port, for reflecting the first fraction of the input signal to thereby generate the first reflected signal to the through port; and a second reflection load, electrically connected to the coupled port, for reflecting the second fraction of the input signal to thereby generate the second reflected signal to the coupled port, wherein at least one of the first and second reflection loads is equivalent to a transmission line; and a signal combiner, electrically connected to the plurality of reflection-type phase shifters, for combining output signals respectively generated from the plurality of reflection-type phase shifters to generate a combined signal;

wherein the at least one of the first and second reflection loads in each of the plurality of reflection-type phase shifters is a corresponding tunable transmission line comprising:

a plurality of physical transmission line segments connected in series, wherein each of the plurality of physical transmission line segments has a first end and a second end; and a plurality of controllable switches, electrically connected to the plurality of physical transmission line segments respectively, wherein each of the plurality of controllable switches has one end directly connected to ground, and each of the plurality of controllable switches is configured for selectively connecting the second end of a corresponding physical transmission line segment to the ground.

4. The phased-array receiver of claim 3, wherein the coupler in each of the plurality of reflection-type phase shifters is a quadrature coupler.

5. A phased-array transmitter, comprising:

a signal splitter, configured for receiving an input signal and generating a plurality of splitter output signals according to the input signal;

a plurality of reflection-type phase shifters, electrically connected to the signal splitter, the plurality of reflection-type phase shifters receiving the plurality of splitter output signals respectively, each of the plurality of reflection-type phase shifters comprising:

a coupler, having an input port for receiving a respective incoming signal generated from the signal splitter, a through port for receiving a first fraction of the respective incoming signal received by the input port, a coupled port for receiving a second fraction of the respective incoming signal received by the input port, and an isolated port for outputting an output signal generated due to a first reflected signal at the through port and a second reflected signal at the coupled port;

a first reflection load, electrically connected to the through port, for reflecting the first fraction of the respective incoming signal to thereby generate the first reflected signal to the through port; and a second reflection load, electrically connected to the coupled port, for reflecting the second fraction of the respective incoming signal to thereby generate the second reflected signal to the coupled port; and a plurality of signal transmitting modules, electrically connected to the plurality of reflection-type phase shifters respectively, the plurality of signal transmitting modules configured for transmitting a plurality of wireless signals according to output signals generated from the plurality of reflection-type phase shifters, respectively;

wherein at least one of the first and second reflection loads in each of the plurality of reflection-type phase shifters is a corresponding tunable transmission line comprising:

an LC ladder network, having transmission line characteristics and comprising a plurality of tunable inductive components and a plurality of capacitive components distributed therein.

6. A reflection-type phase shifter, comprising:

a coupler, having an input port for receiving an input signal, a through port for receiving a first fraction of the input signal, a coupled port for receiving a second fraction of the input signal, and an isolated port for outputting an output signal generated due to a first reflected signal at the through port and a second reflected signal at the coupled port;

a first reflection load, electrically connected to the through port, for reflecting the first fraction of the input signal to thereby generate the first reflected signal to the through port; and a second reflection load, electrically connected to the coupled port, for reflecting the second fraction of the input signal to thereby generate the second reflected signal to the coupled port;

wherein at least one of the first and second reflection loads is a tunable transmission line comprising:

an LC ladder network, having transmission line characteristics and comprising a plurality of tunable inductive components and a plurality of capacitive components distributed therein.

7. A phased-array receiver, comprising:

a plurality of signal receiving modules, configured for receiving wireless signals;

a plurality of reflection-type phase shifters, electrically connected to the plurality of signal receiving modules respectively, each of the plurality of reflection-type phase shifters comprising:

a coupler, having an input port for receiving an input signal generated from a corresponding signal receiving module, a through port for receiving a first fraction of the input signal, a coupled port for receiving a second fraction of the input signal, and an isolated port for outputting an output signal generated due to a first reflected signal at the through port and a second reflected signal at the coupled port;

a first reflection load, electrically connected to the through port, for reflecting the first fraction of the input signal to thereby generate the first reflected signal to the through port; and a second reflection load, electrically connected to the coupled port, for reflecting the second fraction of the input signal to thereby generate the second reflected signal to the coupled port; and a signal combiner, electrically connected to the plurality of reflection-type phase shifters, for combining output signals respectively generated from the plurality of reflection-type phase shifters to generate a combined signal;

wherein at least one of the first and second reflection loads in each of the plurality of reflection-type phase shifters is a corresponding tunable transmission line comprising:

an LC ladder network, having transmission line characteristics and comprising a plurality of tunable inductive components and a plurality of capacitive components distributed therein.

8. A reflection-type phase shifter, comprising:

a quadrature coupler, having an input port for receiving an input signal, a through port for receiving a first fraction of the input signal, a coupled port for receiving a second fraction of the input signal, and an isolated port for outputting an output signal generated due to a first reflected signal at the through port and a second reflected signal at the coupled port;

a first tunable transmission line, electrically connected to the through port, for reflecting the first fraction of the input signal to thereby generate the first reflected signal to the through port; and a second tunable transmission line, electrically connected to the coupled port, for reflecting the second fraction of the input signal to thereby generate the second reflected signal to the coupled port;

wherein each of the first and second tunable transmission lines comprises:

a plurality of physical transmission line segments connected in series, wherein each of the plurality of physical transmission line segments has a first end and a second end; and a plurality of controllable switches, electrically connected to the plurality of physical transmission line segments respectively, wherein each of the plurality of controllable switches has one end directly connected to ground, and each of the plurality of controllable switches is configured for selectively connecting the second end of a corresponding physical transmission line segment to the ground.

9. A reflection-type phase shifter, comprising:

a quadrature coupler, having an input port for receiving an input signal, a through port for receiving a first fraction of the input signal, a coupled port for receiving a second fraction of the input signal, and an isolated port for outputting an output signal generated due to a first reflected signal at the through port and a second reflected signal at the coupled port;

a first tunable transmission line, electrically connected to the through port, for reflecting the first fraction of the input signal to thereby generate the first reflected signal to the through port; and a second tunable transmission line, electrically connected to the coupled port, for reflecting the second fraction of the input signal to thereby generate the second reflected signal to the coupled port;

wherein each of the first and second tunable transmission lines comprises:

an LC ladder network, having transmission line characteristics and comprising a plurality of tunable inductive components and a plurality of capacitive components distributed therein.

10. A phased-array transmitter, comprising:

a signal splitter, configured for receiving an input signal and generating a plurality of splitter output signals according to the input signal;

a plurality of reflection-type phase shifters, electrically connected to the signal splitter, the plurality of reflection-type phase shifters receiving the plurality of splitter output signals respectively, each of the plurality of reflection-type phase shifters comprising:

a coupler, having an input port for receiving a respective incoming signal generated from the signal splitter, a through port for receiving a first fraction of the respective incoming signal received by the input port, a coupled port for receiving a second fraction of the respective incoming signal received by the input port, and an isolated port for outputting an output signal generated due to a first reflected signal at the through port and a second reflected signal at the coupled port;

a first reflection load, electrically connected to the through port, for reflecting the first fraction of the respective incoming signal to thereby generate the first reflected signal to the through port; and a second reflection load, electrically connected to the coupled port, for reflecting the second fraction of the respective incoming signal to thereby generate the second reflected signal to the coupled port; and a plurality of signal transmitting modules, electrically connected to the plurality of reflection-type phase shifters respectively, the plurality of signal transmitting modules configured for transmitting a plurality of wireless signals according to output signals generated from the plurality of reflection-type phase shifters, respectively;

wherein at least one of the first and second reflection loads in each of the plurality of reflection-type phase shifters is a corresponding tunable transmission line comprising:

a plurality of physical transmission line segments connected in series, wherein each of the plurality of physical transmission line segments has a first end and a second end; and a plurality of controllable switches, electrically connected to the plurality of physical transmission line segments respectively, wherein each of the plurality of controllable switches has one end directly connected to ground, and each of the plurality of controllable switches is configured for selectively connecting the second end of a corresponding physical transmission line segment to the ground.

11. The phased-array transmitter of claim 10, wherein the coupler in each of the plurality of reflection-type phase shifters is a quadrature coupler.

* * * * *